US007047955B2

(12) United States Patent
Ookawa et al.

(10) Patent No.: US 7,047,955 B2
(45) Date of Patent: May 23, 2006

(54) CRANKCASE EMISSION CONTROL DEVICE

(75) Inventors: Hisao Ookawa, Yokohama (JP); Michihiro Masubuchi, Kanagawa (JP); Masatoshi Hada, Nagoya (JP)

(73) Assignees: Nissan Motor Co., Ltd., Yokohama (JP); Aichi Machine Industry Co., Ltd., Nagoya (JP)

( * ) Notice: Subject to any disclaimer, the term of this patent is extended or adjusted under 35 U.S.C. 154(b) by 0 days.

(21) Appl. No.: 10/818,178

(22) Filed: Apr. 6, 2004

(65) Prior Publication Data

US 2004/0244783 A1 Dec. 9, 2004

(30) Foreign Application Priority Data

Apr. 7, 2003 (JP) ..... 2003-102418

(51) Int. Cl.
*F01M 13/00* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,601,267 A * 7/1986 Kronich ..... 123/90.33
4,602,595 A * 7/1986 Aoki et al. ..... 123/41.86
4,602,607 A * 7/1986 Balsley ..... 123/574
4,667,647 A 5/1987 Ohtaka et al.
4,760,833 A * 8/1988 Tatyrek ..... 123/574
5,450,835 A * 9/1995 Wagner ..... 123/573
6,065,458 A 5/2000 Ozeki
6,234,154 B1 * 5/2001 Spix ..... 123/572
6,237,577 B1 * 5/2001 Takahashi et al. ..... 123/572
6,412,478 B1 * 7/2002 Ruehlow et al. ..... 123/572
6,508,238 B1 * 1/2003 Furuya ..... 123/572

FOREIGN PATENT DOCUMENTS

JP 2003-001030 A 1/2003

* cited by examiner

*Primary Examiner*—Marquerite McMahon
(74) *Attorney, Agent, or Firm*—Foley & Lardner LLP

(57) ABSTRACT

A crankcase emission control device of an internal combustion engine comprises a gas/liquid separator that separates an oil mist from blow-by gases flowing therethrough. A first passage is defined in both a crankcase and a cylinder head to connect an interior of the crankcase to a valve rocker cover chamber defined by the cylinder head. A second passage extends from the valve rocker cover chamber to the gas/liquid separator. A third passage extends from the gas/liquid separator to an intake system of the engine. For reducing the height of the entire construction of the engine, the gas/liquid separator is integrally formed by the cylinder head at a position below intake ports of the cylinder head.

16 Claims, 4 Drawing Sheets

CRANKCASE EMISSION CONTROL DEVICE

BACKGROUND OF THE INVENTION

1. Field of the Invention

The present invention relates in general to an emission control device of an internal combustion engine, and more particularly to a crankcase emission control device that positively routes blow-by gases from the crankcase to the intake system of the engine. More specifically, the present invention relates to the crankcase emission control devices of a type that positively routes blow-by gases from the crankcase to the intake system through a valve rocker cover chamber of the cylinder head and a gas/liquid separator defined by the cylinder head.

2. Description of the Related Art

Hitherto, various crankcase emission control devices have been proposed and put into practical use in the field of internal combustion engines that are mounted in wheeled motor vehicles. Almost all them are of a type wherein by introducing fresh air into the crankcase, blow-by gases in the crankcase are enforcedly led to the intake system and to the cylinder combustion chambers together with the air-fuel mixture to be burnt. Usually, the crankcase emission control device is equipped at a blow-by gas flowing passage thereof with an oil separator, viz., gas/liquid separator for suppressing migration of a lubrication oil together with the blow-by gases from the crankcase. One of the crankcase emission control devices with such gas/liquid separator is disclosed in Japanese Laid-open Patent Application (Tokkai) 2003-001030. In this disclosed device, the gas/liquid separator is integrally provided on an inner surface of a cylinder head cover that covers an open upper part of the cylinder head.

SUMMARY OF THE INVENTION

However, in some of the known crankcase emission control devices including the above-mentioned disclosed device, the gas/liquid separator has been designed without giving a careful consideration to the size of the same, particularly the height of the same. When the height of the separator increases, the height of the cylinder head cover increases and thus in this case, the height of the entire construction of the engine increases, which restricts the freedom to design the engine room hood as well as the freedom to layout the various parts in the engine room.

It is an object of the present invention to provide a crankcase emission control device of an internal combustion engine, which is free of the above-mentioned shortcomings.

According to the present invention, there is provided a crankcase emission control device which has, in a blow-by gas flowing passage, a gas/liquid separator that is integrally formed by a cylinder head at a position just below intake ports of the cylinder head.

In accordance with a first aspect of the present invention, there is provided a crankcase emission control device of an internal combustion engine. The engine has a cylinder head mounted on a crankcase. The cylinder head has a valve rocker cover chamber defined therein and intake and exhaust ports defined therein. The crankcase emission control device comprises a gas/liquid separator integrally formed by the cylinder head at a position below the intake ports, the gas/liquid separator separating an oil mist from blow-by gases flowing therethrough; a first passage defined in both the crankcase and the cylinder head to connect an interior of the crankcase to the valve rocker cover chamber; a second passage that extends from the valve rocker cover chamber to the gas/liquid separator; and a third passage that extends from the gas/liquid separator to an intake system of the engine.

In accordance with a second aspect of the present invention, there is provided a crankcase emission control device for use in an internal combustion engine. The engine includes a cylinder block, an oil pan mounted beneath the cylinder block, a cylinder head mounted on the cylinder block, and a cylinder head cover mounted on the cylinder head to define therebetween a valve rocker cover chamber, the cylinder block and an upper part of the oil pan being combined to constitute a crankcase, the cylinder head having intake and exhaust ports defined therein. The crankcase emission control device comprises a gas/liquid separator integrally formed by the cylinder head at a position below the intake ports for separating an oil mist from blow-by gases flowing therethrough, the gas/liquid separator including a recess that has an open side directed downward and closed by an upper deck surface of the cylinder block; an oil return passage defined in both the cylinder block and the cylinder head to connect an interior of the crankcase and the valve rocker cover chamber; a blow-by gas inlet passage defined in both the cylinder head cover and the cylinder head to connect the valve rocker cover chamber to an interior of the gas/liquid separator; a blow-by gas outlet passage defined in both the cylinder head and the cylinder head cover, the blow-by gas outlet passage having one end exposed to the interior of the gas/liquid separator; and a PCV valve connected to the other end of the blow-by gas outlet passage for controlling a fluid connection between the blow-by gas outlet passage and an intake system of the engine.

DETAILED DESCRIPTION OF THE INVENTION

In the following, the present invention will be clearly described with reference to the accompanying drawings.

For ease of understanding, various directional terms, such as, right, left, upper, lower, rightward and the like are used in the following description. However, such terms are to be understood with respect to only a drawing or drawings on which a corresponding part or portion is shown.

Figure 1:
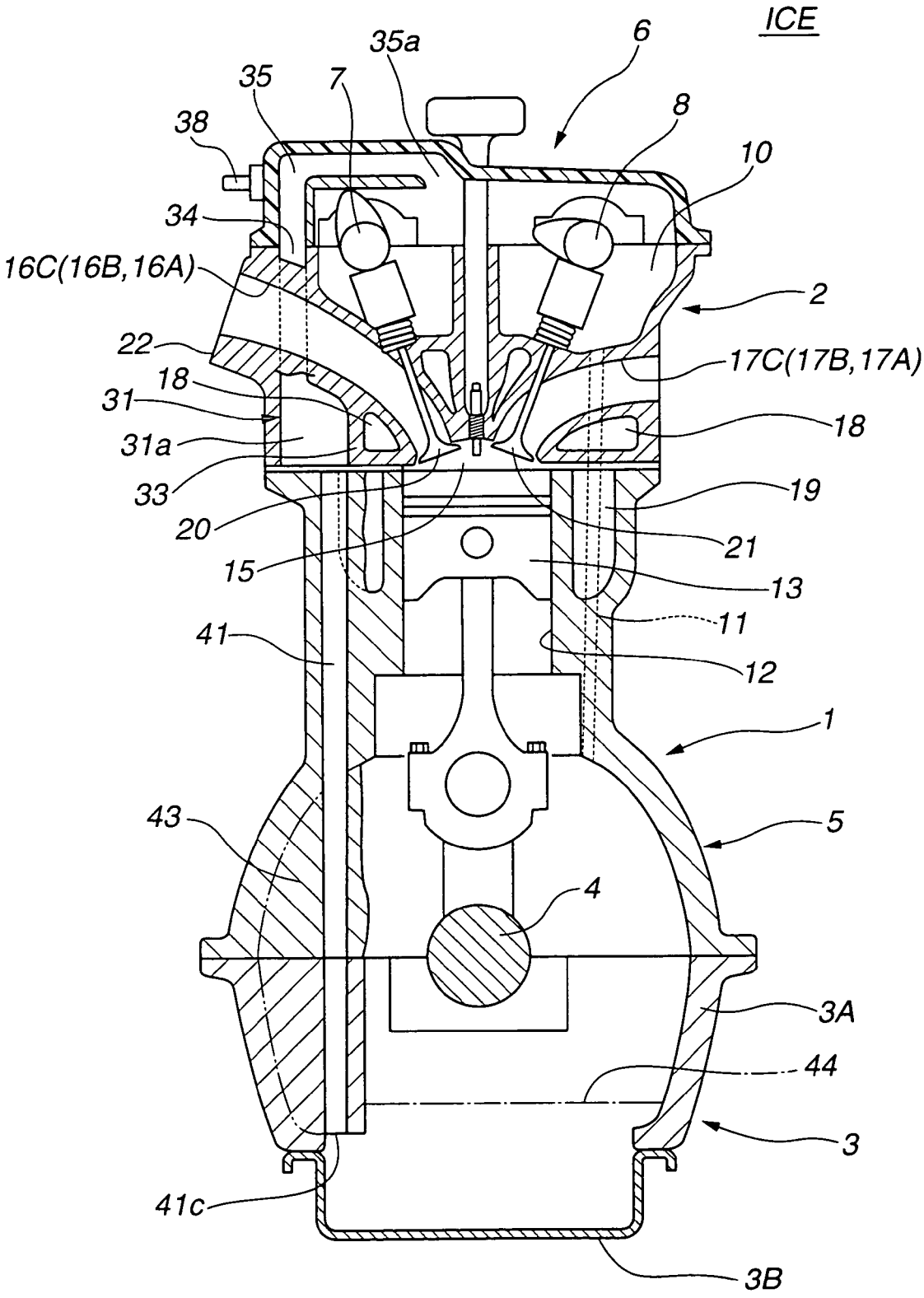
FIG. 1 is a sectional view of an internal combustion engine that is provided with a crankcase emission control device according to the present invention, the sectional view being taken along the line I—I of FIG. 2.
Figure 2:
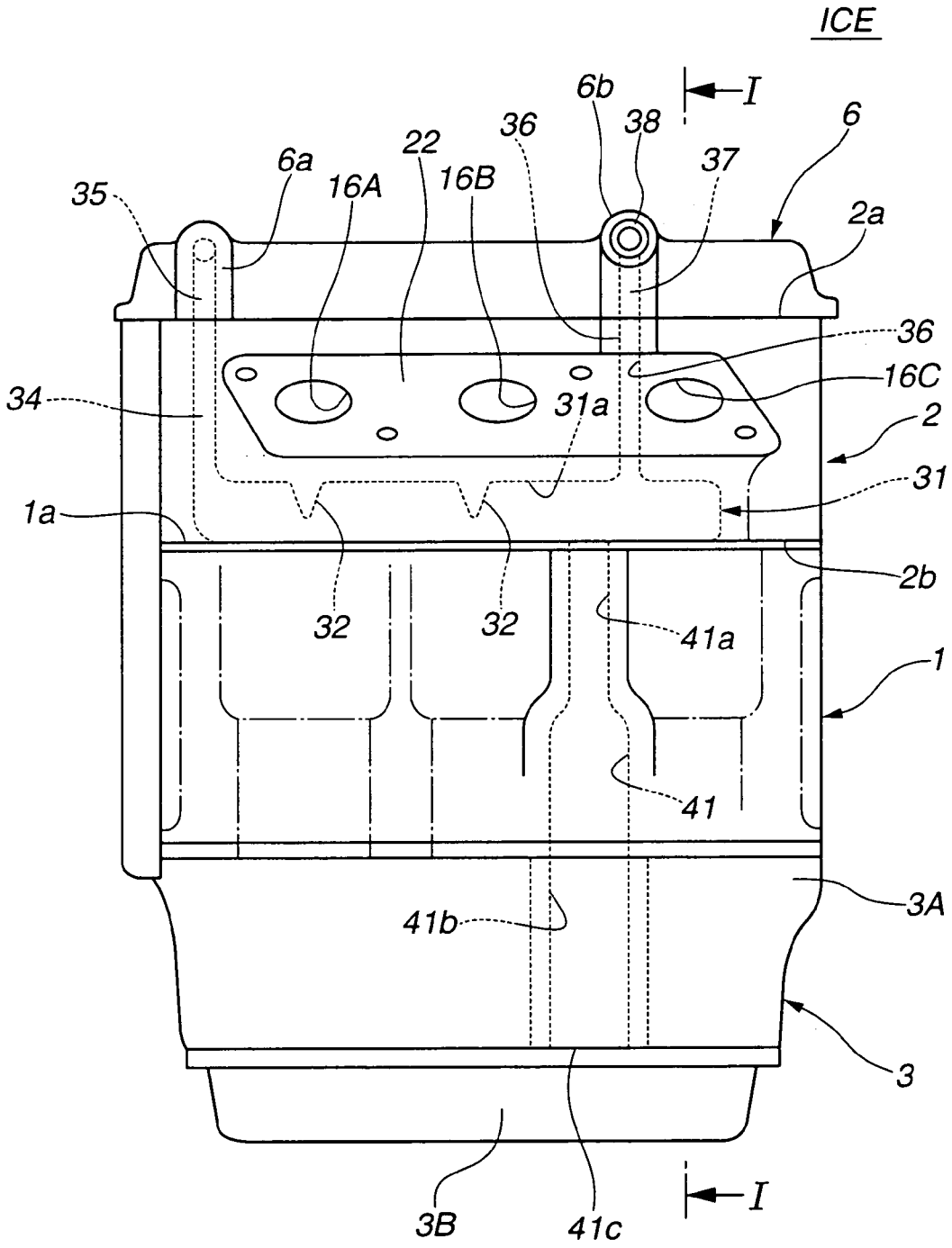
FIG. 2 is a side view of the internal combustion engine.

Referring to the drawings, particularly, FIGS. 1 and 2, there is shown an internal combustion engine ICE that is provided with a crankcase emission control device of the present invention.

The engine ICE shown is of a three-cylinder in-line type that generally comprises a cylinder block 1, a cylinder head 2 mounted on cylinder block 1, and an oil pan 3 mounted beneath cylinder block 1.

In the illustrated engine ICE, oil pan 3 comprises an upper pan part 3A that is cast from aluminum alloy and a lower pan part 3B that is produced by stamping a steel plate. As shown, lower pan part 3B forms an oil pan proper.

Oil pan 3 and cylinder block 1 are united to constitute a crankcase 5 in which a crankshaft 4 is rotatably installed.

As shown, an upper open end of cylinder head 2 is covered by a cylinder head cover 6 constructed of a plastic. Thus, a hermetically sealed valve rocker cover chamber 10 is defined by cylinder head 2 and cylinder head cover 6, in which cam shafts 7 and 8 for intake and exhaust valves 20 and 21 are operatively installed.

From valve rocker cover chamber 10 to oil pan 3, there extend a plurality of oil return passages 11 that are defined by cylinder head 2 and cylinder block 1. The valve rocker cover chamber 10 is also communicated with the interior of crankcase 5 through a chain chamber (not shown) that is provided at a front end of the engine ICE for housing a timing chain. Accordingly, blow-by gases that get past the piston rings and into crankcase 5 is permitted to flow toward valve rocker cover chamber 10 through the oil return passages 11 and the chain chamber.

Cylinder head 2 is cast from an aluminum alloy and has, as is seen from FIGS. 1 and 2, three pairs of intake and exhaust ports 16A, 16B and 16C and 17A, 17B and 17C, each pair extending in different directions from a corresponding combustion chamber 15 defined between cylinder block 1 and cylinder head 2. Cylinder head 2 is formed with a water jacket 18 that surrounds intake and exhaust ports 16A, 16B and 16C and 17A, 17B and 17C. As is known, formation of such water jacket 18 is made by using cores (viz., core sand).

Water jacket 18 of cylinder head 2 is communicated with a water jacket 19 of cylinder block 1 through openings of a cylinder head gasket (not shown) that is hermetically put between cylinder block 1 and cylinder head 2. Of course, water jacket 18 of cylinder head 2 and water jacket 19 of cylinder block 1 may be separated to provide independent water jackets respectively.

As is seen from the drawings, intake and exhaust valves 20 and 21 for each cylinder are directly driven by cam shafts 7 and 8 that are positioned above the valves 20 and 21.

As is seen from FIG. 1, each intake port 16A, 16B or 16C is constructed to have an intake mouth that is somewhat raised as compared with exhaust port 17A, 17B or 17C. The raised intake mouth of intake port 16A, 16B or 16C has an inclined flat flange surface 22 to which an intake manifold (not shown) is mounted.

Figure 3:
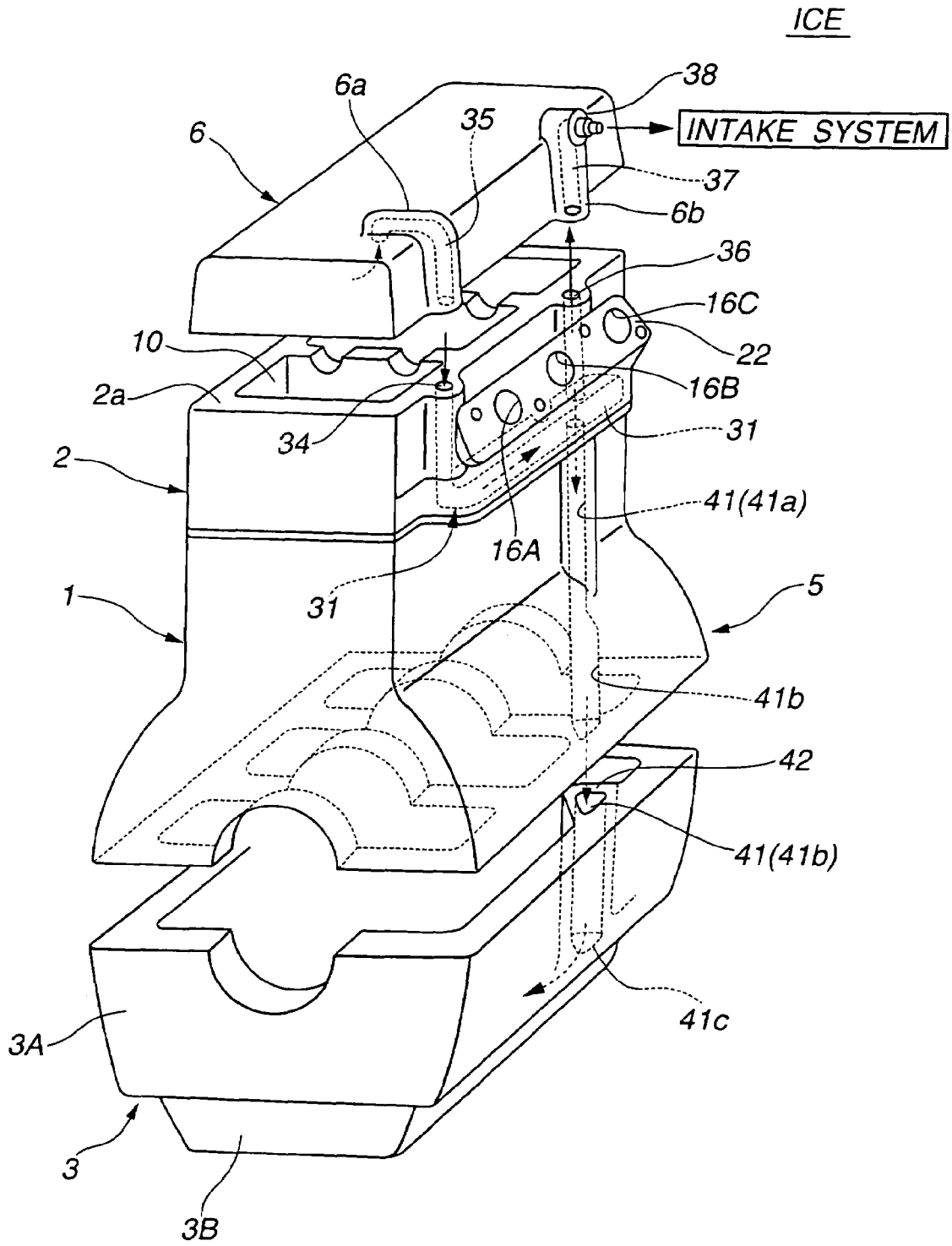
FIG. 3 is an exploded perspective view of the internal combustion engine, clearly showing the arrangement of the crankcase emission control device of the present invention.

As is best seen from FIG. 3, under the three intake ports 16A, 16B and 16C, the cylinder head 2 defines a gas/liquid separator 31 that functions to separate an oil mist from blow-by gases.

Figure 4:
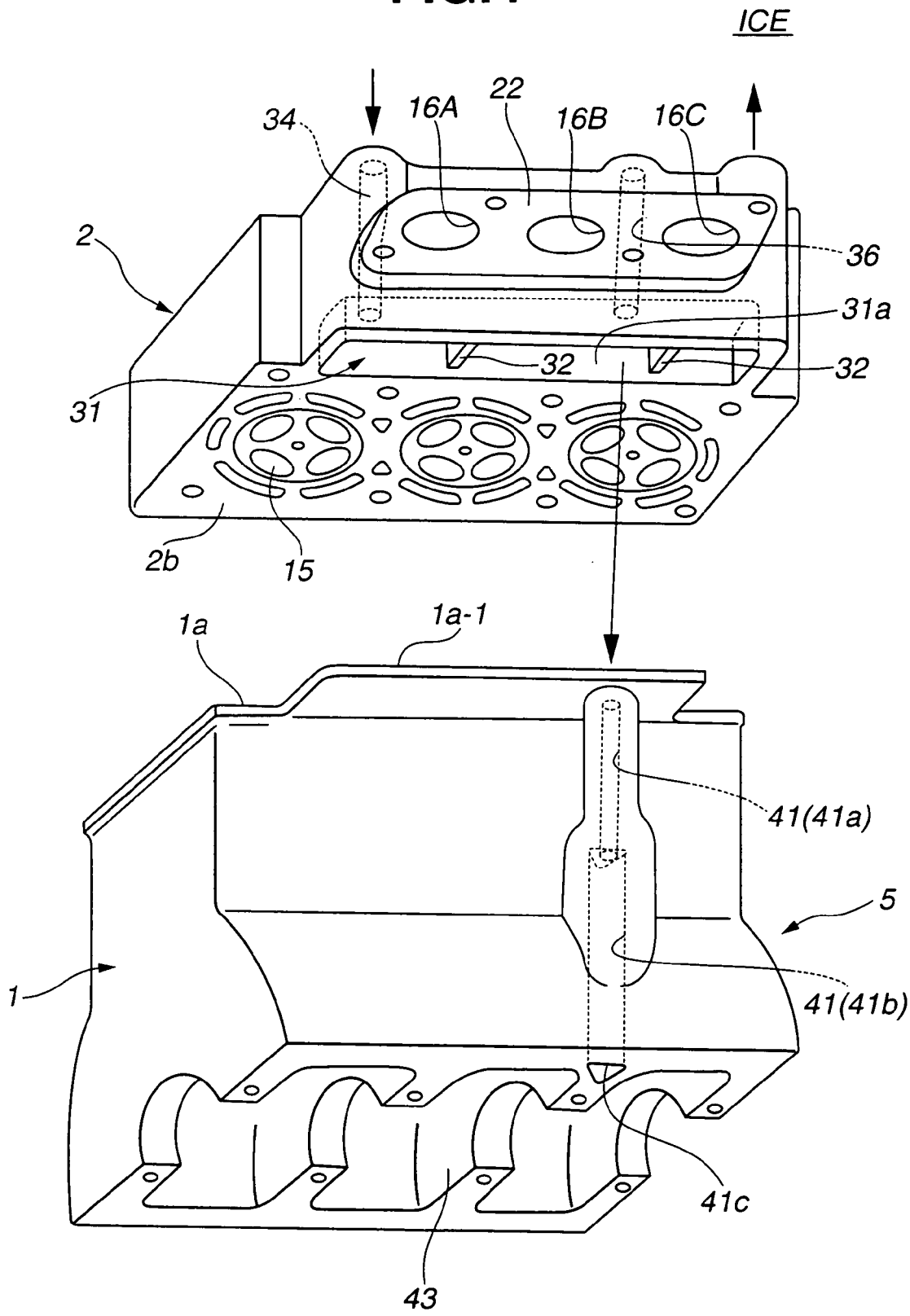
FIG. 4 is an exploded view of the internal combustion engine, showing a cylinder head and a cylinder block viewed from an obliquely lower position.

As is seen from FIG. 4, gas/liquid separator 31 is a rectangular recess 31*a* provided at the time of casting cylinder head 2. As shown, rectangular recess 31*a* is exposed to a lower deck surface 2*b* of cylinder head 2. That is, when cylinder head 2 is properly mounted on cylinder block 1, an upper deck surface 1*a* of cylinder block 1 covers the rectangular recess 31*a*, so that the recess 31*a* has a hermetically sealed construction as gas/liquid separator 31.

As is seen from FIGS. 3 and 4, gas/liquid separator 31 is defined in a side wall of cylinder head 2 that is somewhat projected laterally outward. Thus, upper deck surface 1*a* of cylinder block 1 has a lateral extension 1*a*-1 that abuts against a periphery of rectangular recess 31*a* of cylinder head 2 with an extended part of the cylinder head gasket (not shown) intimately put therebetween. That is, between the periphery of rectangular recess 31*a* and the lateral extension 1*a*-1, there is intimately and hermetically put the extended part of the cylinder head gasket as a sealing member.

As is seen from FIG. 4, within rectangular recess 31*a*, there are arranged two spaced baffle plates 32 by which rectangular recess 31*a* is partitioned into three chambers. Each baffle plate 32 extends downward from an upper wall (viz., bottom) of rectangular recess 31*a* and is arranged to cross the flow of blow-by gases in the recess 31*a*. Each baffle plate 32 is shorter in length than the depth of the recess 31*a*, so that upon mounting of cylinder head 2 on cylinder block 1, there is defined a clearance below the lower end of each baffle plate 32 through which blow-by gases are permitted to flow.

It is to be noted that baffle plates 32 are integral with the cylinder head 2. Due to the one side open construction of rectangular recess 31*a* with baffle plates 32, such recess 31*a* is easily formed without using cores (viz., core sand) upon casting of cylinder head 2.

As is seen from FIG. 1, rectangular recess 31*a* extends along a longitudinal axis of engine ICE, that is, along water jacket 18 leaving a thinner partition wall 33 therebetween.

As is understood from FIGS. 2 to 4, from one longitudinal end of rectangular recess 31*a*, there extends upward a blow-by gas inlet passage 34 that is defined in cylinder head 2, and from a portion near the other longitudinal end of rectangular recess 31*a*, there extends upward a blow-by gas outlet passage 36 that is defined in cylinder head 2.

As is seen from FIG. 3, blow-by gas inlet passage 34 has an upper end exposed to a cylinder head cover mounting surface 2*a* of cylinder head 2. To the upper end of passage 34, there is connected a blow-by gas inlet passage 35 that is defined in a swelled portion 6*a* provided by cylinder head cover 6.

Referring back to FIG. 1, the blow-by gas inlet passage 35 of cylinder head cover 6 has one inlet end 35*a* that is exposed to an inner surface of a roof portion of cylinder head cover 6 and the other end (no numeral) that is connected to the upper end of blow-by gas inlet passage 34 of cylinder head 2 (see FIG. 3).

As is seen from FIG. 3, like the above-mentioned blow-by gas inlet passage 34, blow-by gas outlet passage 36 has an upper end exposed to cylinder head cover mounting surface 2*a* of cylinder head 2. To the upper end of passage 36, there is connected a blow-by gas outlet passage 37 that is defined in a swelled portion 6*b* provided by cylinder head cover 6. The outlet passage 37 is equipped at an upper end thereof with a flow control valve 38, viz., PCV valve (positive crankcase ventilation valve). From an outlet opening of flow control valve 38, there extends a pipe (not shown) to an intake system of the engine ICE, that is, to a downstream area of a throttle valve (not shown) where a suitable negative pressure is produced under operation of the engine ICE.

Although not shown in the drawings, between the mounting surface 2*a* of cylinder head 2 and a mounting surface of cylinder head cover 6, there is intimately and hermetically put a gasket. Although not shown, the gasket has two extended portions that are formed with circular openings through which the fluid connection between blow-by gas inlet passages 34 and 35 and the fluid connection between blow-by gas outlet passages 36 and 37 are respectively and hermetically achieved.

As is understood from FIGS. 3 and 4, blow-by gas inlet and outlet passages 34 and 36 of cylinder head 2 are placed at positions that do not interfere with the three intake ports 16A, 16B and 16C. In the illustrated embodiment, blow-by gas inlet passage 34 is positioned axially outside of intake port 16A of the first cylinder, and blow-by gas outlet passage 36 is positioned between intake port 16B of the second cylinder and intake port 16C of the third cylinder, as shown. However, if desired, blow-by gas outlet passage 36 may be positioned axially outside of intake port 16C of the third cylinder.

As is best understood from FIGS. 1 and 3, for draining the oil (viz., liquid of collected oil mist) from gas/liquid separator 31, there extends an oil draining passage 41 from the separator 31, which passes through cylinder block 1 and upper pan part 3A of oil pan 3. In the illustrated embodiment, oil draining passage 41 has an inlet opening that is exposed to the interior of gas/liquid separator 31 at a position just below blow-by gas outlet passage 36.

That is, as is seen from FIGS. 3 and 4, the inlet opening of oil draining passage 41 is exposed to upper deck surface 1*a* of cylinder block 1, and the passage 41 extends downward in a bulk head 43 of cylinder block 1 and is exposed to a lower surface of cylinder block 1, and as is seen from FIGS. 2 and 3, the passage 41 then extends downward in an inwardly swelled part 42 of upper pan part 3A of oil pan 3 and is exposed to a lower surface of upper pan part 3A. Through a gasket (not shown) put between cylinder block 1 and upper pan part 3A, a hermetical connection between the passage 41 of cylinder block 1 and that of upper pan part 3A is made.

As is seen from FIG. 1, an outlet opening 41*c* of oil draining passage 41, that is exposed to the lower surface of upper pan part 3A, is positioned below a normal level 44 of the lubrication oil reserved in oil pan 3. If desired, an extension tube may extend downward from outlet opening 41*c* for assuring that the outlet opening of oil draining passage 41 is constantly below the level of the lubrication oil in oil pan 3.

As is seen from FIGS. 2 and 4, a lower part 41*b* of oil draining passage 41 has a larger cross sectional area than an upper part 41*a* of the same. Due to provision of such larger cross sectional part 41*b*, undesired back flow of the lubrication oil in draining passage 41 toward gas/liquid separator 31 is suppressed. That is, under operation of the engine ICE, the interior of the separator 31 is subjected to a negative pressure. Thus, if draining passage 41 fails to have a sufficient containing capacity, such back flow would induce undesired back flow of the lubrication oil into the separator 31. It is to be noted that the junction position between upper and lower parts 41*a* and 41*b* is determined based on the maximum pressure difference appearing between the separator 31 and the crankcase 5, the height of the separator 31 from the level of the lubrication oil in oil pan 3 and the buffer distance between the head of the possible lubrication oil column in the draining passage 41 and the bottom surface of gas/liquid separator 31. If desired, the draining passage 41 may comprise three or more parts that have different cross sectional areas, or may have a longitudinal cross section of which area gradually increases as the distance from the bottom surface of gas/liquid separator 31 increases.

In the following, operation of the crankcase emission control device of the present invention will be described with reference to the drawings.

For ease of understanding of the operation, the arrangement of the crankcase emission control device will be briefly reviewed in the following with reference to FIGS. 1 and 3.

As is seen from FIG. 3, an outlet port of flow control valve 38 is connected through a pipe (not shown) to a downstream area of the throttle valve of engine ICE where a negative pressure is produced when engine ICE is under operation. An inlet port of flow control valve 38 is communicated with valve rocker cover chamber 10 through passages 37 and 36, gas/liquid separator 31, and passages 34 and 35. As is seen from FIG. 1, valve rocker cover chamber 10 is communicated with the interior of crankcase 5 through oil return passages 11 and the chain chamber that is provided at the front end of engine ICE.

This means that the interior of crankcase 5 is communicated with the downstream area of the throttle valve of engine ICE through valve rocker cover chamber 10, gas/liquid separator 31, flow control valve 38 and their connecting passages 11, 35, 34, 36 and 37.

Under operation of engine ICE, the intake system of engine ICE produces a negative pressure at the downstream area of the throttle valve of engine ICE.

Because of the above-mentioned arrangement of the crankcase emission control device, production of the negative pressure at the intake system of engine ICE causes fresh air to enter the interior of crankcase 5 through fresh air introducing passages (not shown).

The fresh air then picks up blow-by gases in crankcase 5, enters valve rocker cover chamber 10 through oil return passages 11 and the chain chamber and enters gas/liquid separator 31 through the passages 35 and 34. As is seen from FIG. 1, since inlet end 35*a* of passage 35 is positioned at the uppermost part of valve rocker cover chamber 10, smoothed flow of blow-by gases into passage 35 is expected and at the same time, due to the same reason, flowing of oil mist into passage 35 is suppressed or at least minimized.

When, as is seen from FIG. 2, the mixture of fresh air and blow-by gases enters gas/liquid separator 31 through passage 34, the flow speed of the mixture is suddenly lowered because of a larger volume of the separator 31. Because of this reason and provision of baffle plates 32, oil mist is effectively separated from blow-by gases. That is, during flow of the mixture in separator 31, oil mist impinges on baffle plates 32 growing oil mist drops on the same, which fall down sliding the same.

As is seen from FIG. 1, during flow in gas/liquid separator 31, the mixture of fresh air and blow-by gases is cooled by cooling water that flows in the adjacent water jacket 18. Thus, the oil mist separation by the separator 31 is effectively carried out.

Referring back to FIG. 2, the mixture thus free of oil mist is led to the intake system of engine ICE (viz., downstream area of the throttle valve) through passages 36 and 37 and flow control valve 38. Blending with the air-fuel mixture, the fresh air and blow-by gases free of oil mist are distributed to the cylinder combustion chambers and burned again.

As will be understood from FIG. 2, during flow of the mixture in passages 36 and 37 that extend vertically, any oil mist drops that would be left on inner surfaces of these passages 36 and 37 fall down into the separator 31 by their own weights. Accordingly, the separator 31 can exhibit a very high oil mist separation effect in spite of its simple structure. A certain amount of oil (viz., lubrication oil) is thus received or collected in the separator 31.

As is seen from FIG. 1, the oil thus received in the separator 31 then falls down to oil pan 3 through oil draining passage 41.

It is to be noted that since outlet opening 41*c* of passage 41 is immersed in the lubrication oil in oil pan 3, the negative pressure condition in gas/liquid separator 31 does not introduce blow-by gases into separator 31 from crankcase 5 through passage 41.

Due to occurrence of the negative pressure condition in separator 31, a lubrication oil column is inevitably formed in oil draining passage 41. However, for the reason that has been mentioned hereinabove, the oil column is suppressed from flowing backward into separator 31.

In the following, advantages of crankcase emission control device of the present invention will be described.

First, as is described hereinabove, in the invention, gas/liquid separator 31 is compactly and integrally provided in cylinder head 2 at a position below intake ports 16A, 16B and 16C. In other words, in the invention, the separator 31 is not provided by cylinder head cover 6. Thus, cylinder head cover 6 can be produced with a reduced height. Thus, the entire construction of engine ICE can have a reduced height, which expands the freedom to design the engine room hood as well as the freedom to layout various parts in the engine room.

Second, for the reasons as mentioned hereinabove, gas/liquid separator 31 of the crankcase emission control device can exhibit a very high oil mist separation effect in spite of its simple structure.

Third, separator 31 comprises rectangular recess 31*a* that is formed in cylinder head 2 with its open side facing downward, and separator 31 is completed by only mounting cylinder head 2 onto cylinder block 1. Due to the one side open structure of rectangular recess 31*a*, a possible machining to the recess 31*a* is easily achieved. Furthermore, due to the same reason, the recess 31*a* can be produced without the aid of cores (viz., core sand) upon casting of cylinder head 2.

Fourth, almost all elements of the crankcase emission control device are integrally provided by major parts of engine ICE, and upon assembly of the major parts, the elements are properly combined to constitute the crankcase emission control device. Thus, reduction in number of parts and reduction in assembling steps are achieved when producing the crankcase emission control device of the present invention.

The entire contents of Japanese Patent Application 2003-102418 filed Apr. 7, 2003 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A crankcase emission control device of an internal combustion engine which has a cylinder head secured to an upper surface of a cylinder block that is formed with cylinders and part of a crankcase, the cylinder head having a valve rocker cover chamber defined therein and intake and exhaust ports defined therein, the crankcase emission control device comprising:

a gas/liquid separator integrally formed by the cylinder head at a position below the intake ports, the gas/liquid separator separating an oil mist from blow-by gases flowing therethrough;

a first passage defined in both the cylinder block and the cylinder head to connect an interior of the crankcase to the valve rocker cover chamber;

a second passage that extends from the valve rocker cover chamber to the gas/liquid separator; and a third passage that extends from the gas/liquid separator to an intake system of the engine.

2. A crankcase emission control device as claimed in claim 1, in which the gas/liquid separator comprises a recess that is formed in the cylinder head having its open side directed toward the crankcase, the open side being closed by an upper deck surface of a cylinder block of the crankcase.

3. A crankcase emission control device as claimed in claim 2, in which the gas/liquid separator is equipped with at least one baffle plate that is arranged to cross the flow of the blow-by gases.

4. A crankcase emission control device as claimed in claim 3, in which the baffle plate is integral with the cylinder head.

5. A crankcase emission control device as claimed in claim 2, in which the recess is shaped to extend along a longitudinal axis of the engine.

6. A crankcase emission control device as claimed in claim 1, in which the second passage comprises:

a first passage part defined by the cylinder head and having one end exposed to the gas/liquid separator; and a second passage part defined by a cylinder head cover that is mounted on the cylinder head in a manner to hermetically define the valve rocker cover chamber, the second passage part having one end connected to the other end of the first passage part and the other end exposed to the valve rocker cover chamber.

7. A crankcase emission control device as claimed in claim 1, further comprising an oil draining passage that extends downward through the crankcase from a bottom of the gas/liquid separator to an oil pan that is mounted beneath the crankcase.

8. A crankcase emission control device as claimed in claim 7, in which the oil draining passage has a lower end that is positioned below a level of a lubrication oil reserved in the oil pan.

9. A crankcase emission control device as claimed in claim 8, in which the oil draining passage comprises:

an upper passage part having an upper end exposed to the gas/liquid separator; and a lower passage part having a lower end positioned below the level of the lubrication oil in the oil pan, wherein the lower passage part has a cross sectional area larger than that of the upper passage part.

10. A crankcase emission control device as claimed in claim 1, in which the gas/liquid separator is positioned beside a water jacket that is formed in the cylinder head in a manner to surround the intake and exhaust ports.

11. A crankcase emission control device as claimed in claim 6, in which the other end of the second passage part of the second passage is exposed to the highest position of the valve rocker cover chamber.

12. A crankcase emission control device as claimed in claim 1, wherein the intake and exhaust ports have cams positioned above intake and exhaust valves to drive the intake and exhaust valves.

13. A crankcase emission control device of an internal combustion engine which has a cylinder head mounted on a crankcase, the cylinder head having a valve rocker cover chamber defined therein and intake and exhaust ports defined therein, the crankcase emission control device comprising:

a gas/liquid separator integrally formed by the cylinder head at a position below the intake ports, the gas/liquid separator separating an oil mist from blow-by gases flowing therethrough;

a first passage defined in both the crankcase and the cylinder head to connect an interior of the crankcase to the valve rocker cover chamber;

a second passage that extends from the valve rocker cover chamber to the gas/liquid separator;

a third passage that extends from the gas/liquid separator to an intake system of the engine;

wherein the second passage comprises:

a first passage part defined by the cylinder head and having one end exposed to the gas/liquid separator; and a second passage part defined by a cylinder head cover that is mounted on the cylinder head in a manner to hermetically define the valve rocker cover chamber, the second passage part having one end connected to the other end of the first passage part and the other end exposed to the valve rocker cover chamber;

wherein the third passage comprises:

a third passage part defined by the cylinder head and having one end exposed to the gas/liquid separator; and a fourth passage part defined by the cylinder head cover, the fourth passage part having one end connected to the other end of the third passage part and the other end that is connected to the intake system of the invention.

14. A crankcase emission control device as claimed in claim 13, further comprising a PCV valve that is connected to the other end of the fourth passage part for controlling a fluid connection between the fourth passage part and the intake system.

15. In an internal combustion engine including a cylinder block having cylinders, an oil pan mounted beneath the cylinder block, a cylinder head secured to an upper surface of the cylinder block, and a cylinder head cover mounted on the cylinder head to define therebetween a valve rocker cover chamber, the cylinder block and an upper part of the oil pan being combined to constitute a crankcase, the cylinder head having intake and exhaust ports defined therein, a crankcase emission control device comprising:

a gas/liquid separator integrally formed by the cylinder head at a position below the intake ports for separating an oil mist from blow-by gases flowing therethrough, the gas/liquid separator including a recess that has an open side directed downward and closed by an upper deck surface of the cylinder block;

an oil return passage defined in both the cylinder block and the cylinder head to connect an interior of the crankcase and the valve rocker cover chamber;

a blow-by gas inlet passage defined in both the cylinder head cover and the cylinder head to connect the valve rocker cover chamber to an interior of the gas/liquid separator;

a blow-by gas outlet passage defined in both the cylinder head and the cylinder head cover, the blow-by gas outlet passage having one end exposed to the interior of the gas/liquid separator; and a PCV valve connected to the other end of the blow-by gas outlet passage for controlling a fluid connection between the blow-by gas outlet passage and an intake system of the engine.

16. A crankcase emission control device as claimed in claim 15, in which the gas/liquid separator further comprises a plurality of baffle plates that are arranged in the recess in a manner to cross the flow of the blow-by gases, each baffle plate being integral with the cylinder head and having a vertical length that is smaller than the depth of the recess, and in which the recess extends along a longitudinal axis of the engine and is positioned beside a water jacket that is formed in the cylinder head in a manner to surround the intake and exhaust ports.

* * * * *